US006521399B1

(12) United States Patent
Bourdelais et al.

(10) Patent No.: US 6,521,399 B1
(45) Date of Patent: Feb. 18, 2003

(54) IMAGING MEMBER WITH BIAXIALLY ORIENTED SHEETS CONTAINING OPTICAL BRIGHTENERS

(75) Inventors: Robert P. Bourdelais, Pittsford, NY (US); Peter T. Aylward, Hilton, NY (US); Thaddeus S. Gula, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/093,999

(22) Filed: Jun. 9, 1998

(51) Int. Cl.[7] ..... G03C 1/79

(52) U.S. Cl. ..... 430/523; 430/536; 430/538; 430/631; 430/933

(58) Field of Search ..... 430/536, 538, 430/631, 933, 523

(56) References Cited

U.S. PATENT DOCUMENTS

| | | | | | |
|---|---|---|---|---|---|
| 3,841,943 | A | | 10/1974 | Takushi et al. | 438/141 |
| 3,904,420 | A | * | 9/1975 | Hunter | 96/45 |
| 3,944,699 | A | | 3/1976 | Mathews et al. | 438/220 |
| 4,187,113 | A | | 2/1980 | Mathews et al. | 438/553 |
| 4,283,486 | A | | 8/1981 | Aono et al. | 430/505 |
| 4,377,616 | A | | 3/1983 | Ashcraft et al. | 430/213 |
| 4,582,785 | A | | 4/1986 | Woodward et al. | 430/538 |
| 4,632,869 | A | | 12/1986 | Park et al. | 438/213 |
| 4,758,462 | A | | 7/1988 | Park et al. | 438/315.5 |
| 4,774,224 | A | | 9/1988 | Campbell | 430/945 |
| 4,847,149 | A | * | 7/1989 | Kiyohara et al. | 428/332 |
| 4,994,147 | A | | 2/1991 | Foley et al. | 160/137 |
| 5,011,814 | A | | 4/1991 | Harrison | 503/227 |
| 5,061,610 | A | * | 10/1991 | Carroll et al. | 430/532 |
| 5,096,875 | A | | 3/1992 | Martin | 430/538 |
| 5,198,330 | A | * | 3/1993 | Martic et al. | 430/538 |
| 5,288,690 | A | | 2/1994 | Warner et at. | 503/227 |
| RE34,742 | E | | 9/1994 | Maier et al. | 428/36.5 |
| 5,389,422 | A | | 2/1995 | Okazaki et al. | 438/141 |
| 5,425,990 | A | | 6/1995 | Blum et al. | 438/337 |
| 5,466,519 | A | | 11/1995 | Shirakura et al. | 430/523 |
| 5,514,460 | A | | 5/1996 | Surman et al. | 438/304.4 |
| 5,853,965 | A | * | 12/1998 | Haydock et al. | 430/496 |
| 5,874,205 | A | * | 2/1999 | Bourdelais et al. | 430/496 |
| 6,153,351 | A | * | 11/2000 | Gula et al. | 430/201 |
| 6,273,984 | B1 | * | 8/2001 | Bourdelais et al. | 156/244.22 |

FOREIGN PATENT DOCUMENTS

| | | | | |
|---|---|---|---|---|
| EP | 0 803 377 A1 | | 10/1997 | |
| EP | 0 880 066 | | 11/1998 | |
| EP | 0 880 068 | | 11/1998 | |
| EP | 0 880 069 | | 11/1998 | |
| EP | 926546 | * | 6/1999 | G03C/1/79 |
| EP | 926548 | * | 6/1999 | G03C/1/79 |
| GB | 2 325 759 | | 12/1998 | |
| GB | 2 333 607 | | 7/1999 | |

OTHER PUBLICATIONS

WPI Abstract Acc. No. 91–196889 & JP 3121137 A.
WPI Abstract Acc. No. 87–337836 & JP 62241928 A.

* cited by examiner

*Primary Examiner*—Janet Baxter
*Assistant Examiner*—Amanda C. Walke
(74) *Attorney, Agent, or Firm*—Paul A. Leipold

(57) ABSTRACT

The invention relates to a photographic element comprising at least one biaxially oriented sheet wherein said biaxially oriented sheet when viewed from a surface of said element emits light in the visible spectrum when exposed to ultraviolet radiation.

14 Claims, No Drawings

IMAGING MEMBER WITH BIAXIALLY ORIENTED SHEETS CONTAINING OPTICAL BRIGHTENERS

FIELD OF THE INVENTION

This invention relates to imaging materials. In a preferred form it relates to base materials for photographic color papers.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. It would be desirable if a more reliable and improved surface could be formed at less expense.

In photographic papers the polyethylene layer also serves as a carrier layer for optical brightener and other whitener materials, as well as tint materials. It would be desirable if the optical brightener, rather than being dispersed throughout the polyethylene layer, could be concentrated nearer the surface of the layer where it would be more effective optically.

Prior art photographic materials have suggested that the addition of an optical brightener in the photographic support converts ultraviolet radiation into emitted blue light. This allows the white areas of an image to have a slight blue hue which is preferred by consumers. In traditional photographic support materials, the addition of optical brightener presents some problems in that the optical brightener migrates from the polymer layer to form unacceptable crystals in the imaging layer which significantly reduces the commercial value of the image. Prior art photographic materials avoid this problem by using an expensive form of nonmigrating optical brightener and using less than optimum amounts of optical brightener to prevent unwanted migration. It would be desirable if a less expensive optical brightener could be used that would not migrate into the image layer. Further, it would be desirable to increase the amount of optical brightener to optimize the optical properties of an image without the migration of the optical brightener into the image layer.

It has been proposed in U.S. Pat. No. 5,244,861 to utilize biaxially oriented polypropylene in reflective receiver sheets for thermal dye transfer.

An example of coextruded thin layer technology improvements and limitations is explained in U.S. Pat. No. 5,476,708 where it is proposed that sharpness improvements in photographic systems can be achieved by an untinted, unpigmented, thin skin made to be used under a light sensitive emulsion. A correlation is made suggesting that, if the limits of coextrusion technology are pushed to the maximum, a clear layer of thickness as low as 1.5 $\mu$m is the optimum for optical photographic response.

PROBLEM TO BE SOLVED BY THE INVENTION

There is a need for more effective use of optical brighteners in imaging elements. There is a need for the ability to utilize lower cost optical brighteners. There is also a need to prevent migration of optical brightener into the image forming layers of photographic elements.

SUMMARY OF THE INVENTION

It is an object of the invention to provide improved optical brightening of image elements.

It is another object to provide optical brightening in imaging elements at lower cost.

It is a further object to substantially eliminate migration of optical brighteners into the imaging layers of photographic elements.

These and other objects of the invention are accomplished by an imaging element comprising at least one biaxially oriented sheet wherein said biaxially oriented sheet when viewed from a surface of said element emits light in the visible spectrum when exposed to ultraviolet radiation.

In a preferred embodiment, the invention comprises a photographic element comprising at least one layer comprising photosensitive silver halide and a color coupler and a composite photographic support comprising a paper having bonded to its upper and lower surfaces biaxially oriented polyolefin sheets wherein the biaxially oriented sheet bond to said upper paper surface has in its surface layer or in the layer adjacent to its surface layer an optical brightener.

ADVANTAGEOUS EFFECT OF THE INVENTION

The invention provides improved optical brightening in imaging elements. Further, the imaging elements may be lower in cost and do not exhibit image defects caused by migration of optical brighteners into imaging layers.

DETAILED DESCRIPTION OF THE INVENTION

The invention has numerous advantages over prior practices in the art. The invention provides more effective utilization of optical brighteners resulting in a saving in cost. The optical brighteners are present in thin layers in the biaxially oriented polyolefin sheet and, therefore, are more effective requiring less of the optical brightener to be utilized. Further, in a preferred form of the invention, the optical brightener is in a layer adjacent to the surface layer of the biaxially oriented sheet, thereby substantially eliminating the migration of the optical brighteners from the biaxially oriented sheet into the imaging layers of the imaging member. Another advantage is that the paper base may have the optical brightener removed, as the biaxially oriented sheets containing optical brightener and titanium dioxide have the effect of rendering the coloration and brightening ability of the base paper of little concern.

In present photographic color paper, it is necessary to utilize only anatase titanium dioxide in combination with optical brighteners because the lower cost rutile titanium dioxide interferes with the effectiveness of the optical brighteners that are used. It is surprising that rutile titanium dioxide, when combined with optical brighteners in the thin layer of a biaxially oriented sheet, is effective for the reflective whitening action of the titanium dioxide while the prior optical brighteners also maintain their effectiveness. These and other advantages will be apparent from the detailed description below.

The terms as used herein, "top", "upper", "emulsion side", and "face" mean the side or toward the side of the photographic member bearing the imaging layers. The terms "bottom", "lower side", and "back" mean the side or toward the side of the photographic member opposite from the side bearing the photosensitive imaging layers or developed image.

Any suitable biaxially oriented polyolefin sheet may be utilized for the sheet on the top side of the laminated base of the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462; and 4,632,869, the disclosure of which is incorporated by reference.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density", is calculated as follows:

$$\frac{\text{Composite Sheet Density}}{\text{Polymer Density}} \times 100 = \%\ \text{of Solid Density}$$

should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day. This allows faster emulsion hardening, as the laminated support of this invention does not transmit water vapor from the emulsion layers during coating of the emulsions on the support. The transmission rate is measured by ASTM F1249.

"Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells and, thus, there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization and limited coalescence directly yield very uniformly sized particles.

The void-initiating materials may be coated with an agent to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension are preferred. As the agent, colloidal silica is preferred.

The void-initiating particles can also be inorganic spheres, including solid or hollow glass spheres, metal or ceramic beads, or inorganic particles such as clay, talc, barium sulfate, and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin film is utilized.

For the biaxially oriented sheets on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. In the case of a multiple layer system, when different polymeric materials are used, an additional layer may be required to promote adhesion between non-compatible polymeric materials so that the biaxially oriented sheets do not have layer fracture during manufacturing or in the final imaging element format.

The total thickness of the top most skin layer or exposed surface layer should be between 0.20 $\mu$m and 1.5 $\mu$m, preferably between 0.5 and 1.0 $\mu$m. Below 0.5 $\mu$m any inherent non-planarity in the coextruded skin layer may result in unacceptable color variation. At skin thickness greater than 1.0 $\mu$m, there is a reduction in the photographic optical properties such as image resolution. At thickness greater that 1.0 $\mu$m, there is also a greater material volume to filter for contamination such as clumps, poor color pigment dispersion, or contamination.

Addenda may be added to the topmost skin layer to change the color of the imaging element. For photographic use, a white with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments, and pigment Blue 60.

One detail of this invention is the finding that a very thin layer (0.2 to 1.5 $\mu$m) as the surface layer of the biaxially oriented sheet immediately below the emulsion layer can be made by coextrusion and subsequent stretching in the width and length direction. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Prior colorant placements are often the cause of spot defects due to clumps and poor dispersions. Spot defects, which decrease the commercial value of images, are improved with this invention because less colorant is used, and high quality filtration to clean up the colored layer is much more feasible since the total volume of polymer with colorant is only typically 2 to 10 percent of the total polymer between the base paper and the photosensitive layer.

While the addition of $TiO_2$ in the thin skin layer of the top of the upper biaxially oriented sheet of this invention does not significantly contribute to the optical performance of the sheet, it can cause numerous manufacturing problems such as extrusion die lines and spots. The skin layer preferably is substantially free of $TiO_2$. $TiO_2$ added to a layer between 0.20 and 1.5 $\mu$m does not substantially improve the optical properties of the support. Pigment in the thin skin layer will add cost to the design, and will cause objectionable pigments lines in the extrusion process.

Addenda may be added to the biaxially oriented sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to white defined as a negative b* compared to a white white defined as a b* within one b* unit of zero. b* is the measure of yellow/blue in CIE space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers. Therefore, it is not cost effective to add optical brightener to the biaxially oriented sheet. An emission greater that 5 b* units would interfere with the color balance of the prints making the whites appear too blue for most consumers.

The preferred addenda compound emiting visible light when exposed to ultraviolet light of this invention is an optical brightener. An optical brightener is a colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (O-Cyanostyryl) Benzol, and 2-Amino-4-Methyl Phenol.

Layers below the exposed surface layer in biaxially oriented sheet of the invention may also contain pigments which are known to improve the photographic optical responses such as whiteness or sharpness. Titanium dioxide is used in this invention to improve image sharpness and whiteness and provide the required level of opacity to the biaxially oriented sheets. The $TiO_2$ used may be either anatase or rutile type. For this invention, rutile is the preferred because of the unique particle size and geometry optimize image quality for most consumer applications. Examples of rutile $TiO_2$ that are acceptable for a photographic system are DuPont Chemical Co. R101 rutile $TiO_2$ and DuPont Chemical Co. R104 rutile $TiO_2$. Other pigments to improve image quality may also be used in this invention.

Traditional photographic supports that contain optical brighteners generally use anatase $TiO_2$ in combination optical brightener. The use of rutile $TiO_2$, while preferred for image quality, tends to reduce the efficiency of the optical brightener when optical brighteners and rutile $TiO_2$ are used in combination. Prior art photographic supports containing optical brightener generally use anatase $TiO_2$ in combination with optical brightener. By concentrating the optical brightener and rutile $TiO_2$ in one functional thin layer, rutile $TiO_2$ does not significantly reduce the efficiency of the optical brightener allowing for rutile $TiO_2$ and optical brightener to be used together which improves image quality. The preferred location for the $TiO_2$ is adjacent to the exposed layer. This location allows for efficient manufacture of the biaxially oriented coextruded structure, as the $TiO_2$ does not come in contact with exposed extrusion die surfaces.

The optical brightener may be added to any layer in the multilayer coextruded biaxially oriented polyolefin sheet. The preferred location is adjacent to or in the exposed surface layer of said sheet. This allows for the efficient concentration of optical brightener which results in less optical brightener being used when compared to traditional photographic supports. Typically 20% to 40% less optical brightener is required when the optical brightener is concentrated in a functional layer close to the imaging layers.

When the desired weight % loading of the optical brightener begins to approach a concentration at which the optical brightener migrates to the surface of the support forming crystals in the imaging layer, the addition of optical brightener into the layer adjacent to the exposed layer is preferred. In prior art imaging supports that use optical brightener, expensive grades of optical brightener are used to prevent migration into the imaging layer. When optical brightener migration is a concern, as with light sensitive silver halide imaging systems, the preferred exposed or surface layer comprises polyethylene that is substantially free of optical brightener. In this case, the migration from the layer adjacent to the exposed layer is significantly reduced because the exposed surface layer acts as a barrier for optical brightener migration, allowing for much higher optical brightener levels to be used to optimize image quality. Further, locating the optical brightener in the layer adjacent to the exposed layer allows for a less expensive optical brightener to be used as the exposed layer, which is substantially free of optical brightener and prevents significant migration of the optical brightener to the imaging layers.

Another preferred method to reduce unwanted optical brightener migration in biaxially oriented sheets of this invention is to use polypropylene for the layer adjacent to the exposed surface. Prior art photographic supports generally use melt extruded polyethylene to provide waterproofing to the base paper. Since optical brightener is more soluble in polypropylene than polyethylene, the optical brightener is less likely to migrate from polypropylene to the exposed surface layer.

A biaxially oriented sheet of this invention which has a microvoided core is preferred. The microvoided core adds opacity and whiteness to the imaging support further improving imaging quality. Combining the image quality advantages of a microvoided core with a material, which absorbs ultraviolet energy and emits light in the visible spectrum, allows for the unique optimization of image quality as the image support can have a tint when exposed to ultraviolet energy, yet retain excellent whiteness when the image is viewed using lighting that does not contain significant amounts of ultraviolet energy such as indoor lighting.

Addenda may be also added to the core matrix to further improve the whiteness of these sheets. This would include any process which is known in the art including adding a white pigment, such as titanium dioxide, barium sulfate, clay, or calcium carbonate. This would also include adding fluorescing agents which absorb energy in the ultraviolet region and emit light largely in the blue region, or other additives which would improve the physical properties of the sheet or the manufacturability of the sheet.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. A stretching ratio, defined as the final length divided by the original length for sum of the machine and cross directions, of at least 10 to 1 is preferred. After the sheet has been stretched, it is heat set by heating to a temperature sufficient to crystallize or anneal the polymers while restraining to some degree the sheet against retraction in both directions of stretching.

The composite sheet, while described as having preferably at least three layers of a core and a skin layer on each side, may also be provided with additional layers that may serve to change the properties of the biaxially oriented sheet. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings, which may be used to improve the properties of the sheets including printability to provide a vapor barrier, to make them heat sealable, or to improve the adhesion to the support or to the photo sensitive layers. Examples of this would be acrylic coatings for printability and coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented sheet of the invention where the exposed surface is coated with the imaging layers is as follows:

| |
|---|
| exposed surface layer containing blue pigments |
| adjacent layer containing optical brightener and $TiO_2$ |
| microvoided layer |
| auxiliary layer |
| auxiliary layer |

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thickness higher than 70 $\mu$m, little improvement in either surface smoothness or mechanical properties is seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene, and octene, are also useful. Polypropylenes are preferred because they are low in cost and have good strength and surface properties.

Typical polyesters include those produced from aromatic, aliphatic, or cycloaliphatic dicarboxylic acids of 4–20 carbon atoms, and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. The addition fluorescing agents which absorb energy in the ultaviolet region and emit light largely in the blue region are preferred. The addition of materials which absorb energy in the ultraviolet region and emit light in the blue region to the backside sheet mask the yellowing of the paper as the paper ages with time and temperature. The preferred location for the optical brightener for bottom sheet of this invention is adjacent to the exposed skin layer. This allows for the skin layer to act as a barrier for optical brighener migration.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and a coating polyvinylidene chloride for heat seal properties. Further examples include flame, plasma or corona discharge treatment to improve printability or adhesion.

The structure of a preferred biaxially oriented bottom sheet of the invention where the solid core layer is bonded to the raw base is as follows:

| |
|---|
| treated skin layer |
| solid polymer layer with optical brightener |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371, the disclosure of which is incorporated by reference.

The preferred support is a photographic grade cellulose fiber paper. Traditional photographic grade paper contains optical brightener to provide a slight blue tint to the paper when viewed from the backside. This slight blue tint masks the undesirable yellowing of the paper over time. When optical brighteners are added to the top and bottom sheets, a cellulose base paper substantially free of optical brightener is preferred, as the optical brightener can be concentrated and, thus, more effective in the biaxially oriented sheet laminated to the base paper.

When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheet(s) in order to minimize curl in the resulting laminated receiver support. For high humidity applications (>50% RH) and low humidity applications (<20% RH), it is desirable to laminate both a front side and backside film to keep curl to a minimum.

In one preferred embodiment, in order to produce photographic elements with a desirable photographic look and feel, it is preferable to use relatively thick paper supports (e.g., at least 120 $\mu$m thick, preferably from 120 to 250 $\mu$m thick) and relatively thin microvoided composite packaging films (e.g., less than 50 $\mu$m thick, preferably from 20 to 50 $\mu$m thick, more preferably from 30 to 50 $\mu$m thick).

As used herein, the phrase "imaging element" is a material that may be used as a laminated support for the transfer of images to the support by techniques such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch, and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The elements of the invention may use materials as disclosed in *Research Disclosure* 40145, September 1997, particularly the couplers as disclosed in Section II of the Research Disclosure.

In the following Table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 | I, II, III, IX A & B | including hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which compass the ultaviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Photographic Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26% anionic polyacrylamide, and 5.0% $TIO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 gm/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

EXAMPLES

Example 1

The following laminated photographic bases were prepared by extrusion laminating the following sheets to both sides of a photographic grade cellulose paper support:

Bottom sheet:

BICOR 70MLT (Mobil Chemical Co.)

A one-side matte finish, one-side treated 2 layer polypropylene sheet (18 $\mu$m thick, density=0.900 g/cc) consisting of a solid oriented polypropylene layer and a skin layer of a mixture of polyethylenes and a terpolymer of ethylene-propylene-butylene. The matte finish side was toward the bottom after lamination. The bottom sheet was extrusion laminated to a photographic grade cellulose paper support with an extrusion grade low density polyethylene (density= 0.920 g/cc).

Top Sheet (Emulsion side):

A composite sheet consisting of 5 layers identified as L1, L2, L3, L4, and L5. L1 is the thin colored layer on the outside of the package to which the photosensitive silver halide layer was attached. L2 is the layer to which optical brightener and $TiO_2$ was added. The optical brightener used was Hostalux KS manufactured by Ciba-Geigy. The rutile $TiO_2$ used was DuPont R104 (a 0.22 micrometer particle size $TiO_2$). L6 was the extrusion coated adhesive layer used to laminate the top sheet to the paper support.

The top sheet used in this example was coextruded and biaxially oriented. L6 was not part of this coextruded and biaxially oriented film. Table 1A below shows the layer structure of the support used for this example.

TABLE 1A

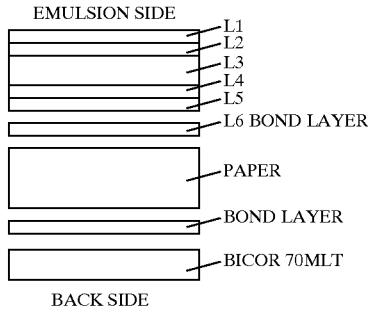

FIG. 1

Table 1B lists the materials used to create each of the layers for this example.

TABLE 1B

| Layer | Material | Thickness, microns |
|---|---|---|
| L1 | LD Polyethylene + color concentrate | 0.75 |
| L2 | Polypropylene + TiO2 + OB | Variable |
| L3 | Voided Polypropylene | 24.9 |
| L4 | Polypropylene | 4.32 |
| L5 | Polypropylene | 0.762 |
| L6 | LD Polyethylene | 11.4 |

The L3 layer is microvoided and further described in Table 2 where the refractive index and geometrical thickness is shown for measurements made along a single slice through the L3 layer; they do not imply continuous layers, and a slice along another location would yield different but approximately the same thickness. The areas with a refractive index of 1 are voids that are filled with air, and the remaining layers are polypropylene.

TABLE 2

| Sublayer of L3 | Refractive Index | Thickness, micron |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Table 3 lists the $TiO_2$ and optical brightener combinations for each sample. The percent values listed in the table below are on a weight basis.

TABLE 3

| Sample | L2 $TiO_2$ Type | L2 $TiO_2$ % | Optical Brightener % |
|---|---|---|---|
| 1 | Anatase | 18 | 0 |
| 2 | Anatase | 18 | 0.15 |
| 3 | Rutile | 18 | 0.15 |
| 4 | Rutile | 18 | 0.60 |
| 5 | Anatase | 18 | 0.60 |

Table 4 lists the LSTAR lightness values and Delta b* values (blue/yellow) ratings for the examples. The delta b* is the difference in measured b* between two light sources. One light source contains a UV component, while the other does not. These ratings are the standard of color measurement in the CIE system measured on a Hunterlab colorimeter. Photographic base papers must have the correct tinting to make them suitable for use in systems which try to reproduce color images correctly.

TABLE 4

| Sample | Delta b* | L* | Optical Brightener % |
|---|---|---|---|
| 1 | 0.07 | 94.30 | 0 |
| 2 | 0.75 | 94.50 | 0.15 |
| 3 | 0.42 | 94.60 | 0.15 |
| 4 | 2.28 | 94.80 | 0.60 |
| 5 | 3.52 | 95.00 | 0.60 |

Further analysis of the sample 4 and 5 shows that the coextruded and then biaxially oriented top sheet was able to provide a desired increase in b* of the photographic element using less than 25% of the normal amounts of optical brightener that is used in traditional photographic supports. In addition, by concentrating the optical brightener in the L2 layer, rutile $TiO_2$ can be used in combination with the optical brightener without significant loss of delta b*. This was an unobvious result, as prior art indicates that an anatase $TiO_2$ should be used in combination with optical brightener to avoid a reduction in delta b*. A reduction in delta b* would result in the addition of more optical brightener increasing cost and increasing the risk of optical brightener migration into the imaging layers. The rutile $TiO_2$ in this experiment provided a higher whiteness (L*) than did the anatase $TiO_2$, thus improving the whiteness of images.

Samples 4 and 5 were also incubated in a 50° C./50% RH oven for 4 weeks. At this keeping condition, 0.60% by weight addition of optical brightener to traditional cast melt extruded polyethylene would result in optical brightener migration from the polyethylene to form unacceptable crystals in the imaging layer. Unexpectedly, the optical brightener loaded in the L2 layer did not migrate, suggesting much higher levels of optical brightener are possible which will allow for optimization of image quality. Additionally, very expensive grades of optical brightener are now used in traditional cast melt extruded polyethylene resin layers to prevent migration into the imaging layer. By loading the optical brightener in L2, a much lower cost optical brightener can now be used to improve image quality.

The invention has been described in detail with particular reference to preferred embodiments thereof, but it will be understood that variations and modifications can be effected within the spirit and scope of the invention.

What is claimed is:

1. An imaging element comprising at least one biaxially oriented sheet on the upper surface of said imaging element wherein said at least one biaxially oriented sheet comprises an optical brightener, said optical brightener is present in an amount between 0.15 and 0.6 percent by weight of the layer located adjacent to the upper surface layer of said biaxially oriented sheet, said upper surface layer of said biaxially oriented sheet is substantially free of white pigment, said biaxially oriented sheet further comprises at least one voided layer adjacent the layer comprising optical brightener, and said biaxialy oriented sheet when viewed from the upper surface of said element emits light in the visible spectrum when exposed to ultraviolet radiation.

2. The imaging element of claim 1 wherein said surface layer comprises a blue colorant.

3. The imaging element of claim 2 wherein said biaxially oriented sheet has a voided core.

4. The imaging element of claim 3 wherein the exposed surface of said biaxially oriented sheet comprises a polyethylene layer.

5. The imaging element of claim 2 wherein the layer adjacent to the exposed surface comprises polypropylene.

6. The imaging element of claim 1 wherein further comprising at least one biaxially oriented sheet is on the lower side of said imaging element.

7. The imaging element of claim 1 wherein the emission of visible light is in the blue spectrum.

8. The imaging element of claim 7 wherein the emission of said light in the blue spectrum is in an amount of 1 to 5 delta b*.

9. The imaging element of claim 1 wherein said white pigment comprises the rutile crystalline form of titanium dioxide.

10. The imaging element of claim 1 further comprising a base paper having biaxially oriented polyolefin sheets adhered to each surface.

11. The imaging element of claim 10 wherein said base paper is substantially free of optical brighteners.

12. A photographic element comprising at least one layer comprising photosensitive silver halide and a color coupler and a composite photographic support comprising a paper having bonded to its upper and lower surfaces biaxially oriented polyolefin sheets wherein the biaxially oriented sheet bonded to said upper paper surface comprises polyethylene, the layer adjacent the surface layer of upper biaxially oriented upper sheet comprises polypropylene and optical brightener, said upper surface layer is substantially free of white pigment and optical brighteners, the layer below the layer comprising optical brightener comprises a voided layer, and said layer adjacent said upper surface layer comprises between 0.15 and 0.6 percent by weight optical brightener.

13. The element of claim 12 further comprising titanium dioxide in a layer below the surface layer of said upper biaxially oriented sheet.

14. The element of claim 13 wherein the upper surface layer of the biaxially oriented sheet that is on the upper side of said paper comprises a blue colorant.

* * * * *